US005758522A

United States Patent [19]

York

[11] Patent Number: 5,758,522

[45] Date of Patent: Jun. 2, 1998

[54] ACCESS CONTROL SYSTEM FOR SECURITY ENCLOSURE

[75] Inventor: James D. York, Salem, Oreg.

[73] Assignee: Microsoft Corporation, Salem, Oreg.

[21] Appl. No.: 748,194

[22] Filed: Nov. 12, 1996

[51] Int. Cl.[6] ..... E05B 65/52

[52] U.S. Cl. ..... 70/63; 70/168; 70/278; 340/825.31; 109/59 R; 109/64

[58] Field of Search ..... 70/63, 278, 277, 70/283, 168, 169; 109/59 R, 59 T, 44, 64, 389; 340/825.31

[56] References Cited

U.S. PATENT DOCUMENTS

| | | | |
|---|---|---|---|
| 3,204,436 | 9/1965 | Nemsky | 70/168 |
| 3,878,511 | 4/1975 | Wagner . | |
| 4,148,092 | 4/1979 | Martin . | |
| 4,575,719 | 3/1986 | Bertagna et al. . | |
| 4,609,780 | 9/1986 | Clark | 340/825.31 |
| 4,615,281 | 10/1986 | Gaston | 109/59 R |
| 4,727,368 | 2/1988 | Larson et al. . | |
| 4,777,556 | 10/1988 | Imran . | |
| 4,838,052 | 6/1989 | Williams et al. | 70/278 |
| 4,851,652 | 7/1989 | Imram | 235/382 |
| 5,090,222 | 2/1992 | Imran | 70/63 |
| 5,136,870 | 8/1992 | Gartner et al. | 70/277 |
| 5,280,518 | 1/1994 | Danler et al. | 379/102.06 |
| 5,423,198 | 6/1995 | DiVito et al. | 70/278 |
| 5,437,174 | 8/1995 | Aydin | 70/423 |
| 5,460,020 | 10/1995 | Hungerford | 109/53 |
| 5,550,529 | 8/1996 | Burge | 70/455 |
| 5,605,066 | 2/1997 | Hurskainen | 70/278 |
| 5,640,863 | 6/1997 | Frolov | 70/283 |

FOREIGN PATENT DOCUMENTS

WO90/13080 11/1990 WIPO .

OTHER PUBLICATIONS

Supra brochure: *Supra Rapid Entry*, Supra Products, Inc., P.O. Box 3167, Salem, OR 97302.

*Primary Examiner*—Darnell M. Boucher

*Attorney, Agent, or Firm*—Klarquist Sparkman Campbell Leigh & Whinston, LLP

[57] ABSTRACT

Electronic access control of a seldom-used outdoor security enclosure, such as a key vault, is provided by a vault lid and key system whereby the procedure for opening the enclosure occurs in two stages. One stage is a low-force stage provided by electromechanical mechanisms housed within the lid and energized by a relatively low power source. The high-force stage is provided by a human operator applying manual force to open the lid. The system is particularly adapted for security enclosures that are exposed to an outdoor environment and not operated for extended periods of time.

7 Claims, 4 Drawing Sheets

ACCESS CONTROL SYSTEM FOR SECURITY ENCLOSURE

FIELD OF THE INVENTION

The present invention relates to electronic access control devices and systems employing same, including those wherein locking lids for security enclosures such as key vaults are adapted for extended periods of non-use in an outdoor environment.

BACKGROUND AND SUMMARY OF THE INVENTION

The field of electronic access control is a mature one, with several distinct classes of systems.

One class of electronic access control system is commonly used in hotels and includes a plurality of guest room door locks operated in conjunction with a control station that is often located at the front desk. The door locks are powered either by an internal battery or by central wiring, but generally are not otherwise connected to the control station. The control station is used to program an access card (often a magnetic stripe card) with data enabling it to access a particular door lock. In some systems, when such a card is first used with a door lock, the card/lock interaction serves to reprogram the lock so that it will no longer respond to the magnetic stripe card of an immediately-preceding occupant. In this manner, some limited reprogramming of such locks can be accomplished. Additional reprogramming can be accomplished by an accessory programming device which can be taken door-to-door and interfaced with each lock to alter certain instructions or data therein.

Another class of electronic access control system is the CardKey system and its competitors, used at industrial facilities and the like. In such systems, doors throughout the facility are equipped with electronically-releasable latches. When a person desires access through such a door, an access card is held next to a reader. The reader interrogates the card and, if it is found to be valid, momentarily actuates the door latch to allow passage. (In some systems, the user is additionally required to enter a personal identification number on a keypad associated with the lock.) The reader is generally wired to a central control station so that a log identifying persons passing through each door can be maintained. Power to operate the readers and the door latches is generally provided through central wiring.

Yet another class of electronic access control system is the Supra Advantage Express system and other electronic real estate lockbox systems. In such systems, thousands of identical lockboxes are mounted on houses listed for sale within a geographical area. Each contains the key to the house with which it is associated. The lockboxes can be opened by keys carried by real estate agents. In operation, a real estate agent first enters a personal identification number on a key to activate it, and then engages the key with a lockbox to gain access to the house key contained therein. Both the key and lockbox have memories in which details of the access are logged. This data can later be transferred to a central database, for example, over a telephone line using an audio transducer in the key, to track lockbox accesses throughout the system. In most such systems, power to operate the lockbox is provided from the key. Additional details on such systems are found in U.S. Pat. Nos. 4,777,556; 4,800,255; 4,851,652; 4,864,115; 4,967,305; 5,046,084; 5,090,222; 5,280,518; and 5,475,375; the disclosures of which are incorporated herein by reference.

Each of the foregoing electronic security systems is tailored for a particular application, and serves that particular application well. Other applications, however, have not been addressed by the electronic security industry.

Consider a fire department. When summoned to a building after hours by a fire alarm, firemen must generally break down a door to gain access to the building. Once in, they may need to have keys to gain control of the building's elevators and internal offices.

To avoid the need for breaking down doors, and to supply needed elevator keys and the like, some municipalities require that building owners mount a key vault on the building exterior (accessible only by ladder) containing keys for use by fire department personnel. Such vaults, in the past, have been secured by mechanical locks, opened by a conventional master key.

One problem posed by the foregoing application is that the lock may rest, unused, for a period of years. With the temperature extremes of outdoor environments, coupled with the tendencies of weathered lubricants to lose their effectiveness over a period of years, the locking mechanism may tend to stick in the locked position. Since battery-powered locking systems can provide only limited actuation forces (i.e. unlocking forces), battery-powered locks may have been considered unsuitable for such applications. Moreover, batteries age and can become unusable in outdoor environments. Further, the battery must be quite large for carrying sufficient energy to operate when the locking mechanism is affected by snow and ice.

According to one aspect of the invention, a lid for a seldom used outdoor security enclosure or key vault is unlocked by an electronic key in cooperation with a manually-applied unlocking force.

In a preferred embodiment, the unlocking force is manually applied to a lever that is normally disengaged with lock blades that must be retracted to permit removal of the lid from the vault. Power provided by an electronic key that nests with the lid actuates mechanisms within the lid that cause the lever to link with the locking blades for retracting the blades when the manual force is applied to the lever. The seldom-used outdoor vault need not carry its own power source. Moreover, the key need only supply a relatively small amount of power since the key is not providing the unlocking force but merely facilitating the application of the relatively large unlocking force by the manipulated lever.

The foregoing and additional features and advantages of the present invention will be more readily apparent from the following detailed description, which proceeds with reference to the accompanying drawings.

DETAILED DESCRIPTION

Figure 1:
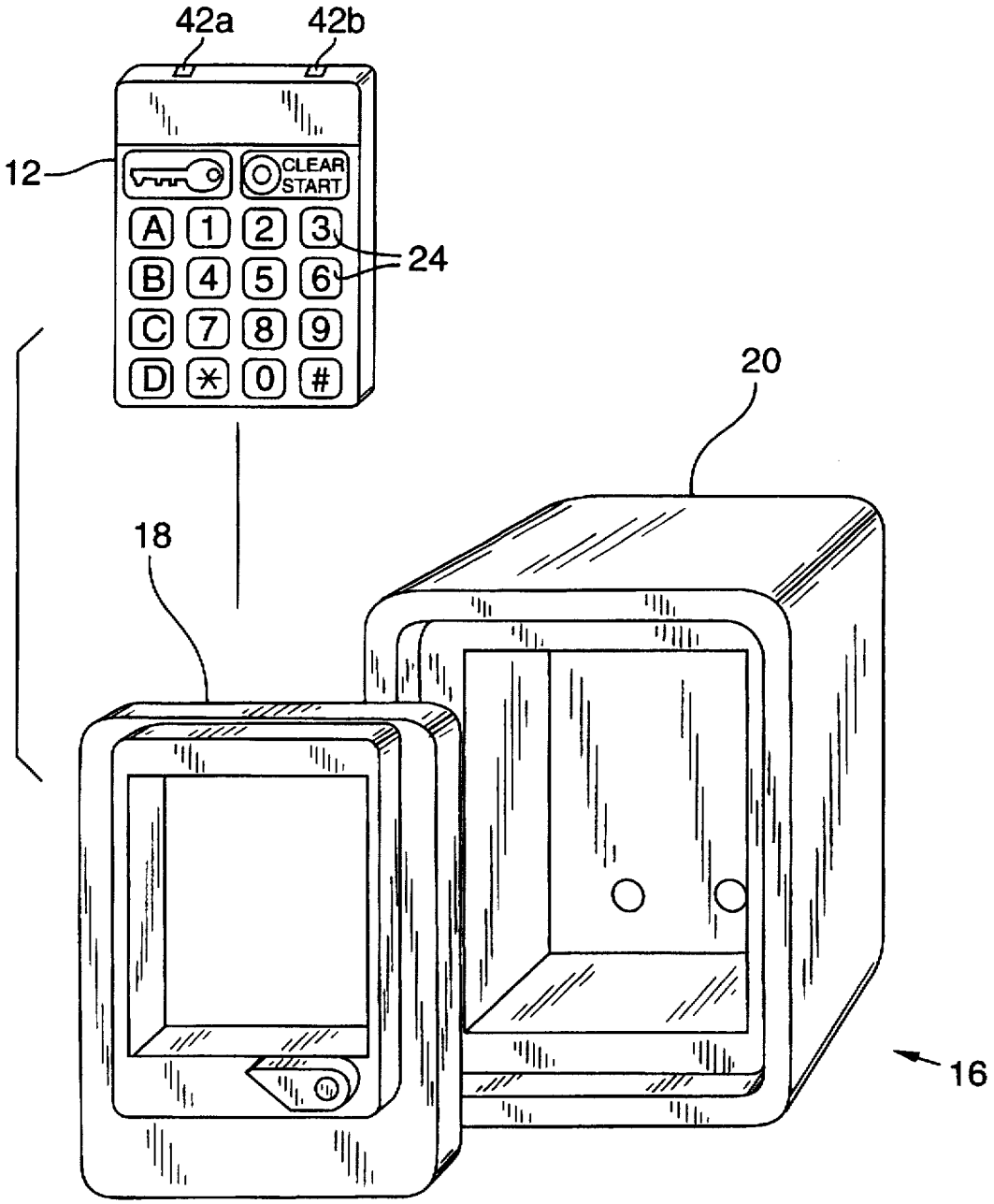
FIG. 1 shows the primary components of an access control system according to one embodiment of the invention.

Referring to FIG. 1, an exemplary access control system according to one embodiment of the present invention includes an electronic key 12, and a security enclosure, such as a key vault 16. The vault 16 includes a body 20 and removable lid 18 and is constructed for outdoor use.

Figure 2:
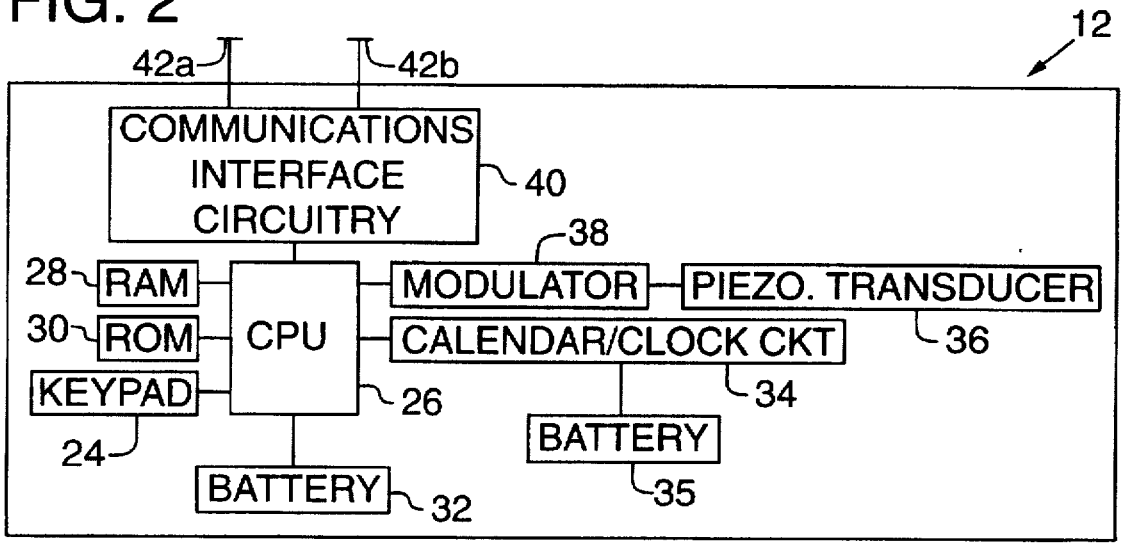
FIG. 2 shows a block diagram of an electronic key component of the system.

As shown in FIG. 2, illustrated key 12 includes a keypad 24 and houses a CPU 26, RAM and ROM memories 28, 30, a primary battery 32, a calendar/clock circuit 34, a piezoelectric transducer 36 with associated modulator 38, and a communications interface 40. The illustrated communications interface employs two electrical contacts 42*a*, 42*b* exposed on top of the key, but other coupling arrangements (e.g. more than two contacts, inductive coupling, optoelectronic coupling, etc.) can alternatively be used. In other embodiments, key 12 can include a small alphanumeric display (e.g., LCD) and/or one or more indicator lights (e.g., LEDs).

Contacts 42*a*, 42*b* connect to corresponding elements on the vault lid 18, as described below. Illustrated communications interface 40 bidirectionally couples data signals between the key 12 and lid 18 in the form of modulation on a power signal provided from the electronic key 12 to lid 18. Key 12 can serve not only as an access key for the vault 16, but also serves as a data link—relaying data to and from the vault 16. One way of effecting this transfer of data and power over just two contacts is shown in U.S. Pat. No. 5,475,375, hereby incorporated by reference.

CPU 26 can be an Intel microcomputer (e.g. 80C52) which controls operation of the key according to programming instructions permanently stored in ROM 30. The calendar/clock circuit 34 provides data corresponding to the year, month, day, and time.

The illustrated RAM 28 is comprised of a small RAM memory inside the calendar/clock circuit 34, together with 2 EEPROMS, the latter of which can store 2048 (2K) 8-bit bytes of data.

Transducer 36 is used to provide audible feedback to the user signaling a variety of key conditions. The transducer is also used for frequency shift keyed relaying of data from the key to external devices (e.g. through an audio telephone circuit).

Battery 32 comprises three AAA cells which provide power to the key circuitry and, through contacting elements 42, to vault lid 18 as well. An auxiliary battery 35 or storage capacitor (not shown) can be employed to provide power to the calendar/clock circuit 34 when battery 32 is removed and replaced.

Desirably, key 12 is constructed in a trim polycarbonate enclosure sized to fit conveniently in a user's pocket. Additional information on key 12 can be found in U.S. Pat. No. 5,280,518, hereby incorporated by reference.

The vault body 20 may be that of a conventional exterior vault, such as is available from The Knox Company of Irvine, Calif., for containing building access keys for fire department and emergency personnel.

Figure 3:
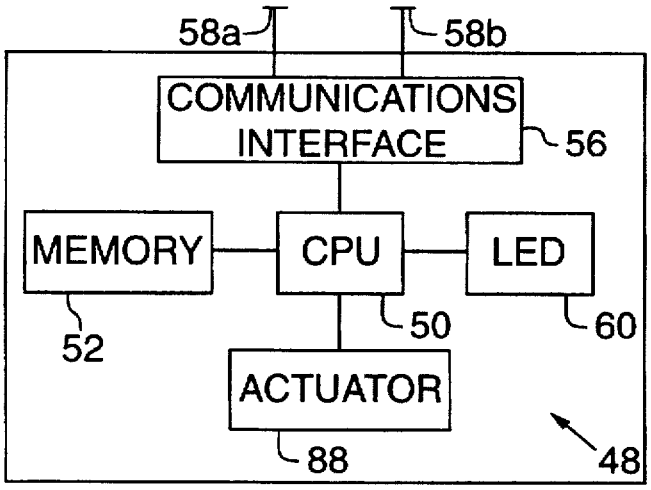
FIG. 3 shows a block diagram of the electronics internal to a lid component of the system.

Referring to FIG. 3, circuitry 48 in the lid 18 of vault 16 includes a CPU 50, a memory 52, an actuator 88, and a communications interface 56. The illustrated communications interface 56 employs two electrical contacts 58*a*, 58*b*, that are exposed in the top of the bezel 70 of the lid, described more below. Other coupling arrangements (e.g. more than two contacts, inductive coupling, optoelectronic coupling, etc.) can be used. The illustrated vault lid 18 additionally includes an indicator LED 60.

Figure 4:
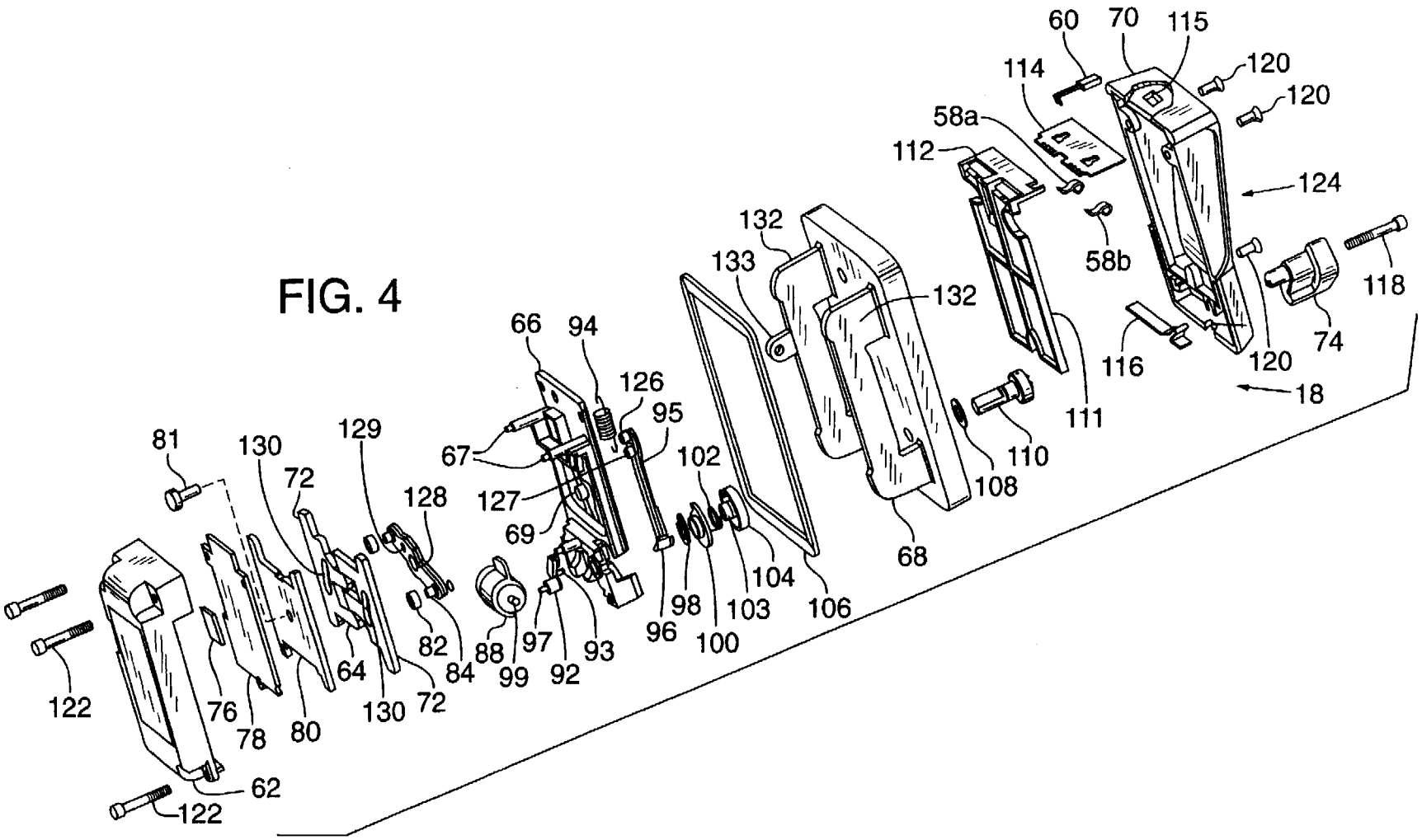
FIG. 4 shows an exploded view of the lid component.

FIG. 4 shows an exploded view of lid 18. As illustrated, lid 18 includes a back cover 62, a pair of cooperating lock blades 64, a chassis 66, a base 68, and a bezel 70.

The outer edges of the lock blades 64 define tabs 72 that normally extend beyond the sides of lid 18 and serve as locking members or bolts that fit into correspondingly shaped openings in the side of the vault body 20 to secure the lid in place on the body. Elevator keys or the like may be stored inside of the vault 20. Preferably, the lid 18 is attached to the body 20 via a cable or chain.

Movement of the lock blades 64 toward each other retracts the tabs 72, thereby allowing the lid to be removed from the body. Such movement of the lock blades is effected by turning a thumb lever 74, as detailed below.

Interposed between the cover 62 and the lock blades 64 are a printed circuit board bumper 76, a printed circuit board 78, and a lock blade cover 80. Printed circuit board 78 contains the circuitry 48 discussed above in connection with FIG. 3, except for actuator 88. The circuit board 78 is fastened by screws to backwardly protruding (i.e., to the left in FIG. 4) posts 67 integrally formed with the chassis 66. The lock blade cover 80 is a rigid plate that is fastened by a shoulder screw 81 extending through a central aperture and into a threaded central hub 69 on the chassis 66. The lock blade cover 80 bears against the back-facing surfaces of the lock blades to ensure that the motion of the lock blades generally remains in a single plane.

Figure 6:
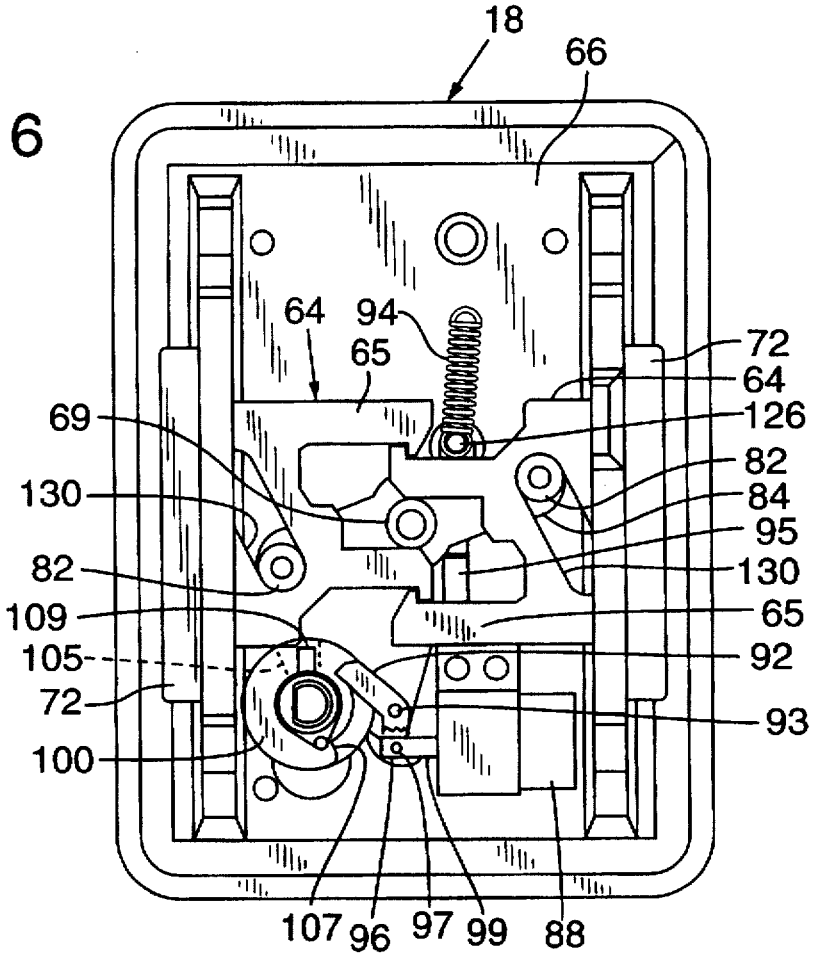
FIG. 6 is a back cutaway view of the lid component.

As best shown in FIG. 6, the inner ends of the lock blades 64 terminate in legs 65 that are configured and arranged about the central hub 69 in the chassis so that the motion of the lock blades 64 is restricted to limited translational motion for extending and retracting the tabs 72.

Interposed between lock blades 64 and chassis 66 is a tie plate 84. The tie plate 84 is a generally elongate member having a clear central aperture 128 through which the shoulder screw 81 passes. As a result, the tie plate is rotatably mounted to the chassis 66 about hub 69 and resides within a recess formed in the back surface of the chassis 66.

The tie plate 84 carries at each end a bushing 82 that protrudes from the chassis recess and fits within a slot 130 formed in a lock blade 64. As best shown in FIG. 6, the long axis of the slots 130 are oriented to be angled relative to the direction of movement of the lock blades 64 so that clockwise (with respect to FIG. 6, counterclockwise with respect to FIG. 5) rotation of the tie plate 84 effects a limited cam (tie plate) and follower (lock blades) action such that the rotational movement of the tie plate is transferred to the translational sliding of the lock blades to retract the tabs 72.

The mechanisms for effecting rotation of the tie plate (hence, retraction of the lock blades) include a link 95 that is carried on the front of the chassis 66. One end of the link 95 carries two posts, one of which, 126, receives the end of an extension spring 94. The other end of the extension spring 94 is hooked to a post on the chassis 66, thus the link is normally urged by the spring 94 upwardly (FIG. 6). The other post 127 in the end of the link pivotally fits into a hole 129 formed in the tie plate 84 at a location eccentric to the central aperture 128.

The other end of the link 95 includes a hook 96 that normally rides along the external surface of a code wheel 104. The code wheel 104 is rotatably mounted between the base 68 and the front of the chassis 66. More particularly, the code wheel 104 is a generally annular-shaped member having a central sleeve 103 that receives one end of a pivot lock 110 that fits through a hole in the base 68. That end of the pivot lock 110 is generally cylindrical except for a flat that engages a flat formed inside the sleeve 103 so that the pivot lock is keyed to the code wheel 104. A washer 108 is positioned between the pivot lock 110 and the base 68.

Figure 5:
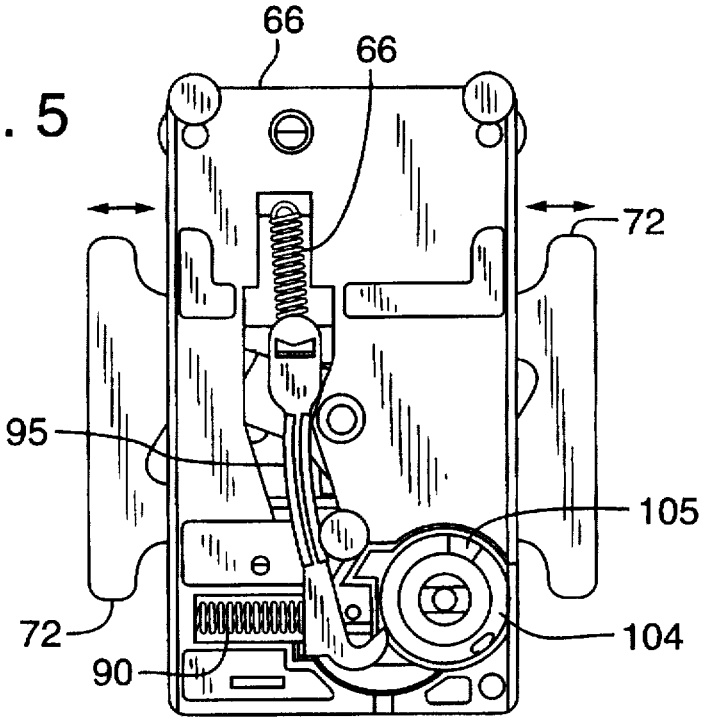
FIG. 5 is a front cutaway view of the lid component.

The outer radial surface of the code wheel 104 is continuous except for a gap 105 formed therein as best shown in FIG. 5.

A generally annular recess is defined in the back side of the code wheel between the sleeve 103 and the outer surface of the wheel. A torsion spring 102 fits within the recess. One end of the torsion spring is anchored within the code wheel and the other end of the torsion spring protrudes from the recess along a line parallel to the rotational axis of the code wheel 104. That end of the spring fits into a hole formed in a cover plate 100.

The cover plate 100 is a generally disc-shaped member having most of its outer diameter corresponding to that of the code wheel 104. More particularly, the outermost radial surface of the cover plate 100 is interrupted with an arcuate-shaped notch 107, best seen in FIG. 6. The cover plate fits around the sleeve 103 of the code wheel and generally encloses the recess within which the torsion spring 102 is carried. The cover plate is held in place by a snap ring 98 that engages the innermost end of the pivot lock 110 and the chassis 66. The cover plate is free to rotate somewhat about the sleeve relative to the pivot lock 110.

As best shown in FIG. 5, a compression spring 90 is fit within a recess in the chassis 66 and oriented so that it continuously urges the hook 96 of the link 95 to ride along the outer radial surfaces of the code wheel 104 and cover plate 100.

The cover plate 100 is movable relative to the code wheel 104 for alternately blocking and unblocking movement of the hook 96 into the gap 105 that is defined in the outer surface of the code wheel. In this regard, the torsion spring 102 normally urges the cover plate 100 to rotate into an orientation such that notch 107 in the outer radial surface of the cover plate is spaced from the gap 105 in the code wheel, thereby preventing the hook 96 from fitting within the gap 105. The back-facing surface of the cover plate 100 includes a projecting stop 109 that can be in abutting contact with one end of an actuator latch 92 for the purpose of permitting rotation of the code wheel 104 relative to the cover plate 100 so that the hook 96 can engage the gap 105 in the code wheel as described next.

The actuator latch 92 (a portion of which is broken away in FIG. 6 for clarity) is pivotally mounted to the chassis (shown as pivot point 93 in FIG. 6). One end of the latch includes a pivot pin 91 that fits into a transverse hole in a normally extending shaft 99 of a solenoid 88 that is mounted to the back of the chassis beneath the lock blades 64. The solenoid 88 comprises, in cooperation with the actuator latch 92, the actuator assembly for facilitating the application of manual unlocking force to the lid as will become clear.

Whenever the solenoid 88 is provided with a suitable electrical signal (which is derived from the electronic key 12 as mentioned above), the solenoid shaft 99 is retracted (to the right in FIG. 6) and pulls with it the pivotally attached pin 97 of the actuator latch. As a result, the opposing end of the latch 92 moves into a position (FIG. 6) for abutting the stop 109 on the cover plate. As a result, rotation of the pivot lock 110 and connected code wheel 104, which rotation is generated by manually applied force to a connected thumb lever 74 as described later, while the actuator is in the just-described position (which rotation appears clockwise in FIG. 6) moves the gap 105 of the wheel toward engagement with the hook 96 of the link 95. The stop 109 on the cover plate, however, will abut the latch 92 so that rotation of the cover plate 100 is halted with the notch 107 of the cover plate being generally adjacent the hook 96.

Continued turning of the code wheel 104 will move the gap 105 in that wheel next to the region of the notched part of the cover plate and adjacent the hook 96 so that the hook is forced by the compression spring 90 to fit into the gap. When this occurs, further rotation of the code wheel 104 pulls the link 95 downwardly, thereby rotating the tie plate 84 for retracting the tabs 72 of the lock blades. The tabs 72 retract by an amount sufficient to remove them from the corresponding-shaped openings in the vault body 20 so that the lid 18 can be removed to expose the contents of the vault.

The back cover 62 and the base 68 are fastened together by screws 122. A gasket 106 is applied to the lid 18 and compressed between the vault 20 and lid when the lid is closed, thus sealing the entire vault interior from the outdoor environment. Inwardly protruding flanges 132 on the back of the base 68 serve to protect the sides of the components that are enclosed by the back cover. The flanges 132 also surround the extended tabs 72 of the lock blades when the lid is closed, thereby resisting bending or shearing of the lack blades that might otherwise occur as a result of an attempted forced opening of the vault by prying the lid from the vault. It will be appreciated, therefore, that the electronic components carried by the lid are normally housed within the sealed vault, protected from the outdoor environment.

Preferably, a bracket 133 protrudes from one flange 132 for the purpose of providing a mechanism for attaching the lid to one end of a cable that is also attached to the vault body.

The bezel 70 is anchored to the front of the base 68 by screws 120. Between the bezel and base is a thin plastic (polycarbonate) plate 111 that includes a flange 112 to which is mounted a small printed circuit board 114 that carries the above-mentioned contacts **58*a*, 58*b*. That board 114 also carries the LED 60. The flange and printed circuit board fit into a correspondingly shaped pocket formed by two spaced-apart walls in the upper end of the bezel 70. The innermost wall includes openings, one of which is shown at 115, through which protrude the contacts 58*a* and 58*b* for engagement with the contacts 42*a*, 42*b* of the key 12. Wires (not shown) between the board and the solenoid 88** deliver the electrical signal from the key to the solenoid for retracting its shaft as described earlier.

The thumb lever 74 is fastened via screw 118 through the bezel 70. The innermost end of the lever 74 engages the outer end of the pivot lock 110 so that rotation of the thumb lever 74 is directly transferred to the pivot lock 110. In a preferred embodiment, a detent spring 116 is fit between the bezel and the thumb screw to hold the thumb screw in a normal position such that a nest 124 defined by the bezel remains clear for receiving the key.

In operation, a key 12 is fitted into the nest 124 defined by the bezel. In this position, contacts **42*a*, 42*b* on the key engage with contacts 58*a*, in the 58*b*** lid. Preferably, an electronic handshaking sequence then ensues, followed by a request from the key to access the lock.

If the vault CPU 50 determines that the key properly authorized entry to the vault body 20, the CPU causes an actuation signal to be sent to solenoid 88 and to the LED 60. Solenoid 88 responds by pivotally moving actuator latch 92 into position for abutting stop 109 so that the hook 96 may engage the gap 105 in the code wheel 104, thus rotating the tie plate 84 to retract the lock blades, as described above, when thumb lever 74 is rotated.

It should be noted that the thumb lever 74 is shaped so that movement of thumb lever 74 to unlock the lid also serves to block removal of key 12 from the nest 124. Accordingly, the key cannot be withdrawn from the lid until the lid is again returned to its locked position (i.e. by counter-rotating the thumb lever).

It will be recognized that the opening procedure just detailed has two stages: a first low-force stage and a second high-force stage. The low force in the first stage is provided by the key-powered movement of the actuator latch. The high force in the second stage is provided by a human operator via manipulation of the thumb lever.

Having described the principles of our invention with reference to several preferred embodiments and variations thereon, it should be apparent that the invention can be modified in arrangement and detail without departing from such principles. Although the preferred embodiments have been described as including certain combinations of features, applicants' invention includes alternative embodiments that include other combinations of the features disclosed herein and in the documents incorporated by reference.

Accordingly, it should be recognized that the foregoing embodiments are illustrative only and should not be taken as limiting the scope of the invention. Instead, what is claimed as the invention is all such modifications as may come within the scope and spirit of the following claims and equivalents thereto.

I claim:

1. An access control system for a key vault, comprising:

a lid that carries an extendable and retractable lock member that, when extended, is engageable with the vault to secure the lid to the vault and, when retracted, permits removal of the lid from the vault;

a rotatable member mounted to the lid and alternately positionable to expose and cover a first part of the rotatable member relative a second part of the rotatable member;

a lever member fastened to the rotatable member and protruding outside of the vault from the lid for manipulation by an operator to rotate the rotatable member;

an actuator assembly mounted to the lid and responsive to an electrical signal for movement into contact with the rotatable member to permit the rotatable member to move to the position to expose the first part; and a link assembly carried in the lid and linked to the lock member and engageable with the exposed first part of the rotatable member, the link assembly being movable for retracting the lock member and being moved when engaged with the exposed first part of the rotating rotatable member.

2. The system of claim 1 further comprising a key member that is removably connectable to the lid outside of the vault and that provides a source of electrical power to generate the signal to which the actuator assembly responds.

3. The system of claim 1 wherein the rotatable member and the actuator assembly are located to be sealed inside of the vault when the lid is secured to the vault.

4. The system of claim 1 wherein the rotatable member includes a wheel having the first part carried thereon, and wherein the second part comprises a cover rotatable mounted adjacent to the wheel and that is normally disposed in a first orientation that covers the first part.

5. The system of claim it wherein the cover is mounted for movement relative to the wheel into a second orientation that exposes the first part.

6. The system of claim 5 wherein the actuator assembly contacts the cover in a manner that causes the cover to assume the second orientation as the rotatable member is rotated.

7. The system of claim it further comprising a spring member that is connected to the wheel and that normally urges the cover toward the first orientation, thereby to prevent the link assembly from engaging the first part of the rotatable member in the absence of the electrical signal.

* * * * *

UNITED STATES PATENT AND TRADEMARK OFFICE

CERTIFICATE OF CORRECTION

PATENT NO. : 5,758,522

DATED : June 2, 1998

INVENTOR(S) : James D. York

It is certified that error appears in the above-identified patent and that said Letters Patent is hereby corrected as shown below: On the title page: Item [73]

Assignee "Microsoft Corporation" to --SLC Technologies, Inc--.

Signed and Sealed this

Ninth Day of November, 1999

*Attest:*

Q. TODD DICKINSON

*Attesting Officer*

*Acting Commissioner of Patents and Trademarks*